United States Patent [19]

Riegler et al.

[11] 4,093,192

[45] June 6, 1978

[54] TILTING DRIVE ARRANGEMENT FOR A CONVERTER

[75] Inventors: Ernst Riegler, Enns; Manfred Schmidt, Linz, both of Austria

[73] Assignee: Vereinigte Osterreichische Eisen-und Stahlwerke - Alpine Montan Aktiengesellschaft, Linz, Austria

[21] Appl. No.: 746,236

[22] Filed: Dec. 1, 1976

[30] Foreign Application Priority Data

Dec. 12, 1975 Austria ..... 9449/75

[51] Int. Cl.[2] ..... C21C 5/46

[52] U.S. Cl. ..... 266/78; 266/245; 73/141 A

[58] Field of Search ..... 73/141 A; 266/78, 91, 266/245

[56] References Cited

U.S. PATENT DOCUMENTS

| | | | |
|---|---|---|---|
| 3,197,187 | 7/1965 | Lakin et al. | 266/78 |
| 3,548,678 | 12/1970 | Phillips | 266/245 X |
| 3,918,301 | 11/1975 | Baer | 73/141 A |
| 4,023,785 | 5/1977 | Riegler et al. | 266/245 |

FOREIGN PATENT DOCUMENTS

| | | | |
|---|---|---|---|
| 311,968 | 10/1971 | U.S.S.R. | 266/245 |
| 401,729 | 5/1974 | U.S.S.R. | 266/245 |
| 419,561 | 8/1974 | U.S.S.R. | 266/245 |
| 342,917 | 7/1972 | U.S.S.R. | 266/245 |

*Primary Examiner*—Roy Lake
*Assistant Examiner*—Paul A. Bell
*Attorney, Agent, or Firm*—Brumbaugh, Graves, Donohue & Raymond

[57] ABSTRACT

A tilting drive arrangement for a converter comprises a gear arranged on a tilting trunnion, a torque support for supporting the gear on the base, and a measuring device for measuring the tilting moment, which measuring device is arranged in the torque support between the base and the gear.

6 Claims, 8 Drawing Figures

TILTING DRIVE ARRANGEMENT FOR A CONVERTER

BACKGROUND OF THE INVENTION

The present invention relates to a tilting drive for a converter having a gear arranged on a tilting trunnion of the converter, the gear being supported on the base via a torque support.

When the converter is in operation, disturbances can occur with the consequence that a tilting of the converter is possible only with a tilting moment that is increased as compared to the normal operation of the converter. Such disturbances are, e.g., an overcharging, a collapse of the lining of the converter or a freezing of the bath in the converter. In order to be able to tilt the converter even after the occurrence of these disturbances, the drive motors and the gears usually are designed for much higher performances than are required by operation of the converter without disturbances. However, if these disturbances impede the tilting movement of the converter beyond a certain degree and an attempt is made to further tilt the converter, the gear or the carrying ring may be damaged or a tilting trunnion may even be ripped off.

For reasons related to the production of the drive motors and because of the temperature variations that occur during the operation of the converter, it is not possible to construct the drive motors to precisely the maximum allowable performance of the gear or to the maximum allowable torque to be applied to the tilting trunnion, which would not cause damage to the converter plant. If it is desired to tilt the converter even under as heavy a load as possible, drive motors must be provided that are able to give a higher performance than that which is necessary for the converter plant. When it was necessary to tilt the converter under circumstances impeding tilting, according to the working procedure hitherto used, only the occurrence of the above-described damage has led to a turning off of the drive motors.

SUMMARY OF THE INVENTION

The invention aims at providing a tilting drive for converters which enables tilting of the converter up to loads lying at the limit of the load carrying ability of the complete converter plant, in which, however, damage to the converter plant due to overdimensioned drive motors can be reliably avoided.

In a tilting drive of the above-defined kind, this object is achieved according to the invention in that a measuring means, such as a force measuring cell or a wire strain gauge, for measuring the tilting moment is built into the torque support between the base and the gear. Thus it becomes possible to record the tilting moments that occur and to turn off the drive motors when tilting capable of damaging the plant occur.

Advantageously, an interruption switch for the tilting drive, which switch is controllable by the measuring means, is arranged to follow the measuring means. Thus it becomes possible to automatically turn off the tilting drive when a pre-determinable tilting moment is exceeded.

Suitably, in a tilting drive having a torque support comprising a guide rod hinged to the gear, a lever producing a torsional moment, and a torque rod, supported in bearings on the base, a torsion measuring means is provided on the torque rod.

A preferred embodiment of the tilting drive has a torque support formed by a torque rod rotatably journaled at its ends in bearings, two levers secured to the torque rod at a distance from each other, and two guide rods hinged to the levers as well as to the gear. This tilting drive is characterized in that each guide rod comprises two parts with flanges directed towards each other. Force measuring cells are inserted between the flanges and the flanges are braced relative to each other by screws.

A further embodiment of the tilting drive according to the invention also has a torque support formed by a torque rod that is rotatably journaled in bearings at its ends, two levers secured to the torque rod at a distance from each other, and two guide rods hinged to the levers as well as to the gear. However, this tilting drive is characterized in that force measuring cells are provided between the bearings of the torque rod and the base, and the bearings are braced relative to the base by screws.

BRIEF DESCRIPTION OF THE DRAWING

The invention shall now be described by way of a number of embodiments and with reference to the accompanying drawings, wherein.

DESCRIPTION OF EXEMPLARY EMBODIMENTS

Figure 3:
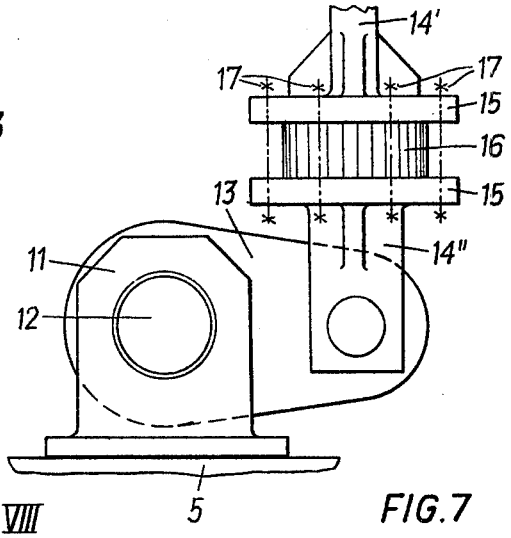
FIG. 3 shows a detail of the torque support on an enlarged scale in a view like that of FIG. 1, FIGS. 4 and 5 show a different embodiment of the tilting drive according to the invention in illustrations analogous to those of FIGS. 1 and 2.

The converter denoted by 1 is mounted in a carrying ring 2 which is journaled with its tilting trunnions 3 and 4 in bearings 6 and 7 supported on the base. At its end the tilting trunnions 3, extended beyond the bearing 6, carries the spur gear wheel arranged in gear housing 8, which spur gear wheel is driven by four pinions distributed over its periphery. The pinions are driven by direct current motors 9. A torque support 10 provides for a resilient support of the gear housing on the base. The torque shaft 12, rotatable in bearings 11, is torsion-strained during a tilting of the converter via the levers 13 secured to the ends of the torque shaft 12 and through the guide rods 14 hinged to the gear housing 8. Each of the two guide rods comprises two parts 14' and 14" with flanges 15 directed toward each other (FIG. 3). Force measuring cells 16 are inserted between the flanges 15. By means of screws 17 the flanges 15 are pressed toward each other in such a manner that the force measuring cells 16 are always under compressive stress, even when the guide rods are under the highest tensile stress that occurs during tilting. With the force measuring cells, which measure the load on the guide rods 14, the tilting moments that occur can be determined, i.e. with the force measuring cell allocated to that guide rod which is under compressive stress. If tilting moments greater than those for which the converter plant has been dimensioned occur, an interruption switch 18, controlled by the force measuring cells and provided in the electrical supply conduit 19 of the drive motors, is actuated. As a result no damage to the converter plant by the drive motors can occur. Instead of the force measuring cells, wire strain gauges could also be provided on the guide rods to actuate the interruption switch 18 when pre-determined elongations of the guide rods occur.

Figure 4:
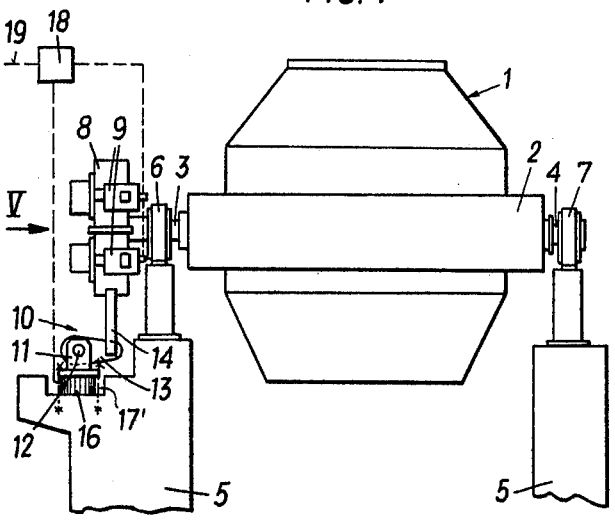
Figure 5:
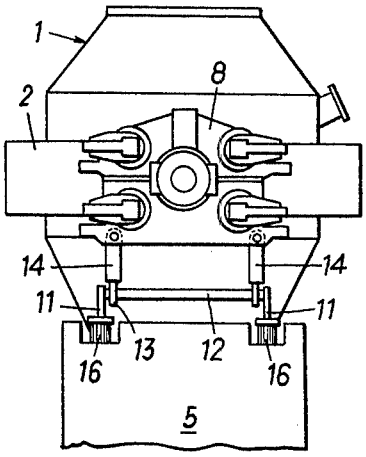

According to the embodiment shown in FIGS. 4 and 5, the force measuring cells 16 are arranged between the bearings 11 of the torque shaft 12 and the base 5. The bearings 11 are braced relative to the base 5 by means of screws 17', so that in this embodiment the force measuring cells are also always under compressive stress.

Figure 6:
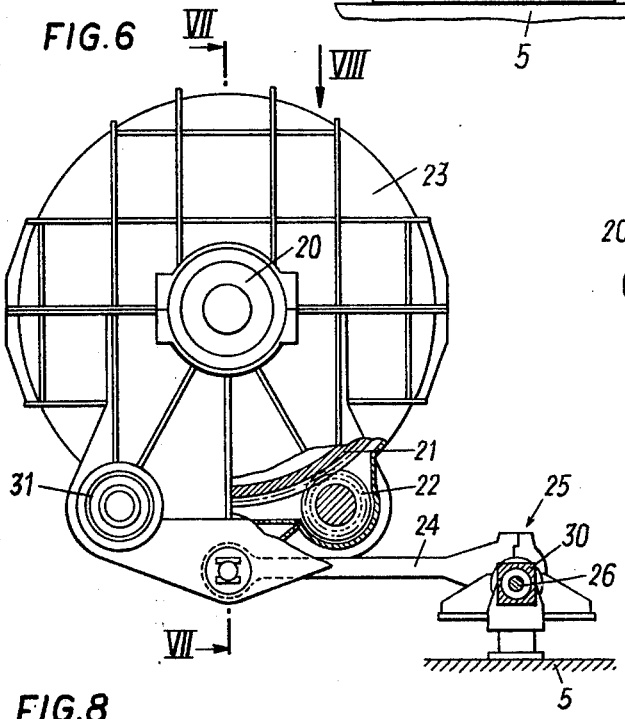
FIG. 6 shows a further embodiment of a tilting drive in an illustration analogous to that of FIG. 2 and without the converter.
Figure 7:
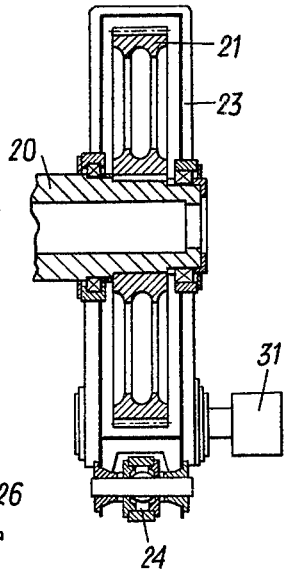
FIG. 7 shows a section along line VII-VII of FIG. 6.
Figure 8:
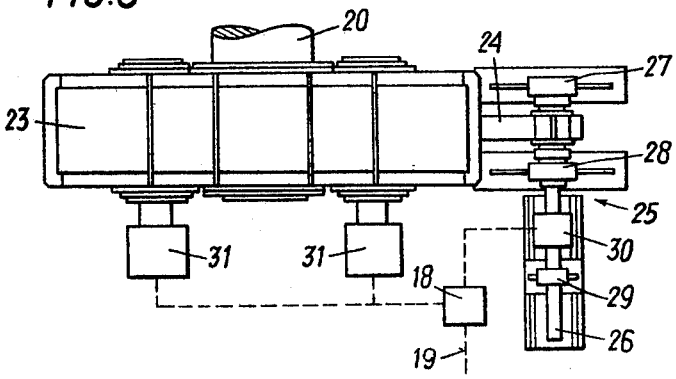
FIG. 8 is a view in the direction of the arrow VIII of FIG. 6.

In FIGS. 6, 7 and 8 relating to a further embodiment according to the invention, a tilting trunnion of the converter carrying ring (not illustrated in detail) is denoted by 20, and a toothed wheel secured to it is denoted by 21, which toothed wheel is drivable by two pinions 22. The pinions 22 are mounted in a gear housing 23 enclosing the toothed wheel 21, which gear housing is pendulously suspended on the tilting trunnion 20. On the gear housing 23, one end of a guide rod 24 of a torque support 25 is hinged. The other end of the guide rod 24 is mounted on a crank of a torque shaft 26. The torque shaft is mounted to be rotatable in supporting brackets 27 and 28 and rigid in supporting bracket 29. A torsion measuring means 30 is arranged on the crank shaft for measuring the tilting moments. This torsion measuring means controls the interruption switch 18 arranged in the electrical supply conduit 19 of the drive motors 31, in the same manner as the force measuring cells previously described.

Figure 1:
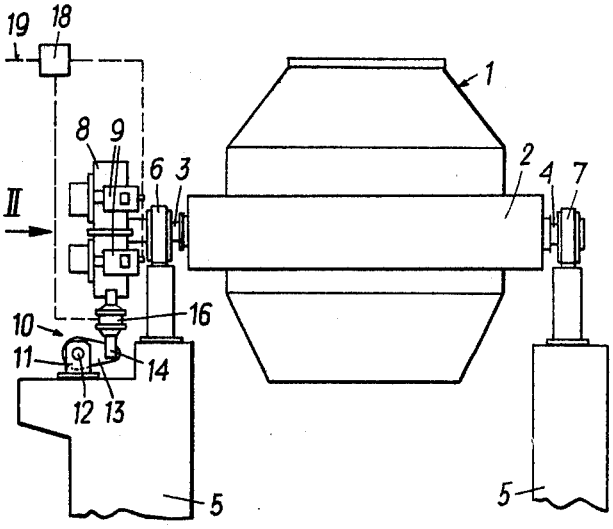
FIG. 1 shows a front view of a converter plant.
Figure 2:
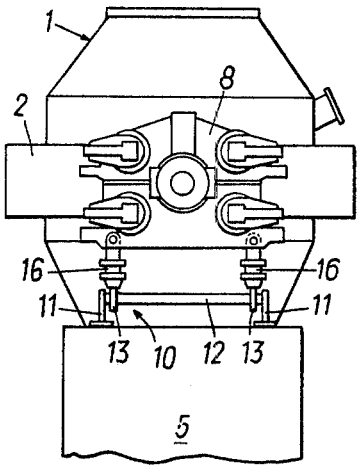
FIG. 2 is a view in the direction of the arrow II of FIG. 1.

According to a further embodiment of the invention, the torque shaft of the exemplary embodiment shown in FIGS. 1 to 3 can also be provided with a torsion measuring means.

The tilting drive according to the present invention is not restricted to a certain kind of drive. It can be realized in the same manner and with the same advantages, when e.g. hydraulic motors are used.

What we claim is:

1. In a tilting drive arrangement for a converter having a gear within a gear housing arranged on a tilting trunnion of the converter and a torque support for supporting the gear housing on a base, the torque support including a guide rod hinged to the gear housing, a torque rod supported on the base in bearings, and a lever arranged to connect the guide rod to the torque rod so as to produce a torsional moment in the torque rod, the improvement comprising a torsion measuring means located on the torque rod for measuring the torque in the torque rod and hence the tilting moments.

2. In a tilting drive arrangement for a converter having a gear within a gear housing arranged on a tilting trunnion of the converter and a torque support for supporting the gear housing on a base, the torque support including a torque rod rotatably journaled at its end in bearings, two levers fastened on the torque rod at a distance from each other, and two guide rods each hinged to the gear and to one of the two levers, the improvement comprising:

two force measuring cells for measuring tilting moments;

flanges on each of two separate parts of each guide rod, the two parts of each guide rod having their flanges directed towards each other, one force measuring cell being provided between the flanges of each guide rod, and screws for bracing said flanges relative to each other.

3. In a tilting drive arrangement for a converter having a gear within a gear housing arranged on a tilting trunnion of the converter and a torque support for supporting the gear housing on a base, the torque support including a torque rod rotatably journaled at its end in bearings, two levers fastened on the torque rod at a distance from each other, and two guide rods each hinged to the gear and to one of the two levers, the improvement comprising:

force measuring cells for measuring tilting moments, said force measuring cells being provided between the bearings of the torque rod and the base, and screws for bracing the bearings relative to the base.

4. In a tilting drive arrangement for a converter having a gear within a gear housing arranged on a tilting trunnion of the converter and a torque support for supporting the gear housing on a base, the improvement comprising:

a measuring means for measuring tilting moments, said measuring means being arranged in the torque support between the base and the gear; and an interruption means for interrupting the tilting drive, said interruption means being controlled by the measuring means.

5. A tilting drive arrangement as set forth in claim 4, wherein the measuring means is a force measuring cell.

6. A tilting drive arrangement as set forth in claim 4, wherein the measuring means is a wire strain guage.

* * * * *